United States Patent [19]

Christopher et al.

[11] Patent Number: 4,803,750

[45] Date of Patent: Feb. 14, 1989

[54] FORK AND COMB CLEANING TOOL

[76] Inventors: Brent Christopher, 8810 Mendenhall Loop Rd., Juneau, Ak. 79801; George Spector, 233 Broadway Rm. 3815, New York, N.Y. 10007

[21] Appl. No.: 42,457

[22] Filed: Apr. 24, 1987

[51] Int. Cl.[4] ..... A47L 17/00

[52] U.S. Cl. ..... 15/104.52

[58] Field of Search ..... 15/104.50, 104.51, 105.52, 15/104.53, 160, 236.1, 236.2, 142, 218.1, 39, 104.54

[56] References Cited

U.S. PATENT DOCUMENTS

| | | | |
|---|---|---|---|
| 421,413 | 2/1890 | Loose | 15/104.52 |
| 1,040,849 | 10/1912 | Bercha | 15/104.52 |
| 1,458,018 | 6/1923 | Alsager | 15/104.51 |
| 1,583,729 | 5/1926 | Masuoka | 15/104.51 |
| 2,036,527 | 4/1936 | Inman | 15/104.52 |
| 3,629,895 | 12/1971 | Colgon | 15/160 |
| 3,964,120 | 6/1976 | Woodford | 15/104.5 |

FOREIGN PATENT DOCUMENTS

| | | | |
|---|---|---|---|
| 460280 | 10/1949 | Canada | 15/104.5 |
| 364549 | 11/1922 | Fed. Rep. of Germany | 15/104.53 |

*Primary Examiner*—Harvey C. Hornsby
*Assistant Examiner*—Joseph S. Machuga

[57] ABSTRACT

A fork and comb cleaning tool is provided that will remove food particles from between fork prongs and scalp particles from between comb teeth with bristle wires on a rectangular frame member held in hand of user of the tool. In a modification the bristle wires are removable so as to be replaced when needed.

1 Claim, 1 Drawing Sheet

FORK AND COMB CLEANING TOOL

BACKGROUND OF THE INVENTION

The instant invention relates generally to cleaning devices and more specifically it relates to a fork and comb cleaning tool.

Numerous cleaning devices have been provided in prior art that are adapted to clean combs and the like. For example, U.S. Pat. Nos. 2,837,755; 3,363,275 and 3,964,120 all are illustrative of such prior art. While these units may be suitable for the particular purpose to which they address, they would not be as suitable for the purposes of the present invention as heretofore described.

SUMMARY OF THE INVENTION

A primary object of the present invention is to provide a fork and comb cleaning tool that will overcome the shortcomings of the prior art devices.

Another object is to provide a fork and comb cleaning tool that will remove food particles from between prongs of a fork and remove scalp particles from between teeth of a comb with fibrous course plastic bristles on steel wire supports.

An additional object is to provide a fork and comb cleaning tool that has removable spring biased steel wires thereon so as to be replaced when needed.

A further object is to provide a fork and comb cleaning tool that is simple and easy to use.

A still further object is to provide a fork and comb cleaning tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
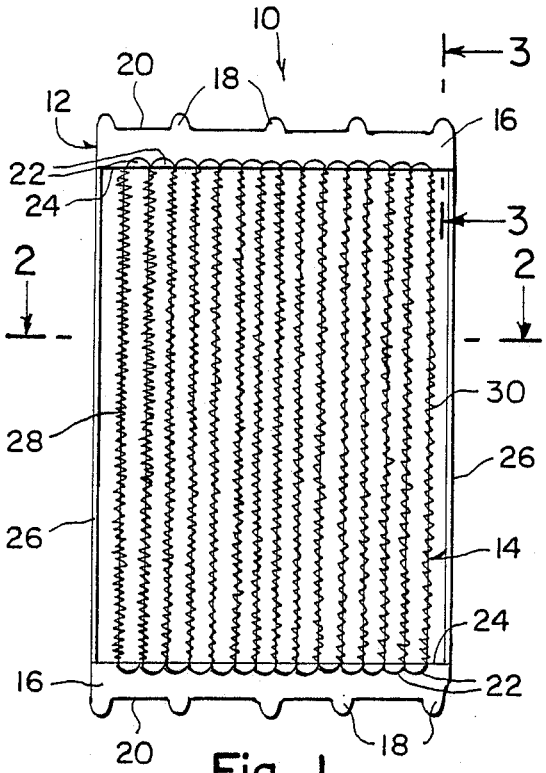
FIG. 1 is a front view of the invention.

Turning now descriptively to the drawings, in which similar reference characters denote similar elements throughout the several views, FIG. 1 illustrates a fork and comb cleaning tool10 consisting of a rectangular frame member 12 to be held in hand of user (not shown) of the tool 10. A plurality of bristle wires 14 are spaced apart and extend longitudinally between end of the frame member 12. The bristle wires 14 will remove food particles from between prongs of a fork and remove scalp particles from between teeth of a comb held in other hand of the user of the tool 10.

The frame member 12 includes pair of hand grip ends 16, each having a plurality of detents 18 on outer side 20 and a plurality of crimped flanges 22 on inner side 24 to hold the bristle wires 14 securely in place. A pair of elongated rods 26 are spaced apart and extend between the hand grip ends 16. Each of the rods 26 is thin enough to fit between the fork prongs and the comb teeth yet strong enough for structural support.

Figure 2:
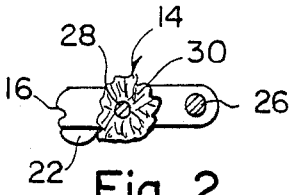
FIG. 2 is an enlarged cross sectional view with parts broken away taken along line 2—2 in FIG. 1.
Figure 3:
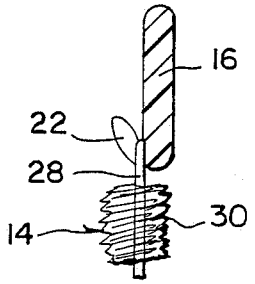
FIG. 3 is an enlarged cross sectional view taken along line 3—3 in FIG. 1.
Figure 4:
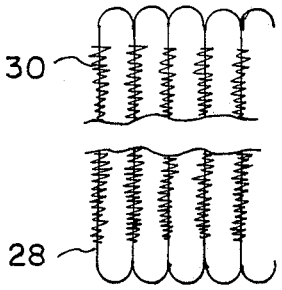
FIG. 4 is a front view showing the steel wire formed as one piece.
Figure 5:
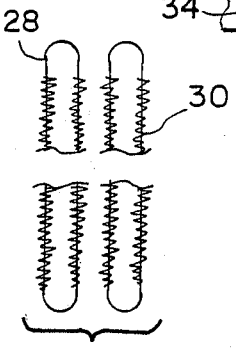
FIG. 5 is a front view showing the steel wires formed as individual pieces.

As best shown in FIGS. 2 and 3, the bristle wires 14 include a series of stainless steel wire loops 28 being in one instance continuous loops (see FIG. 4) and in another instance individual loops (see FIG. 5), both to be held at each end by the crimped flanges 22. Fibrous coarse plastic bristles 30 are formed on each of the wire loops 28.

Figure 6:
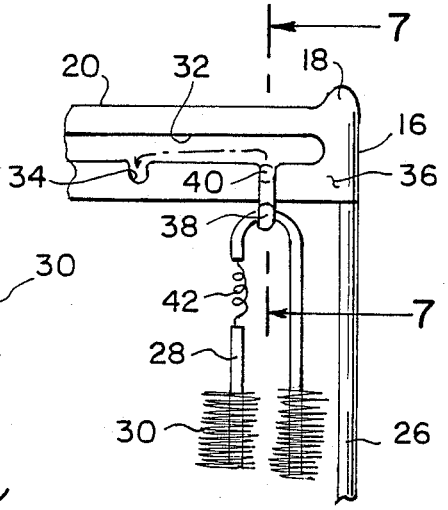
FIG. 6 is an enlarged front view of a modification showing an adjustable hook member within a track to hold a spring biased steel wire thereon.
Figure 7:
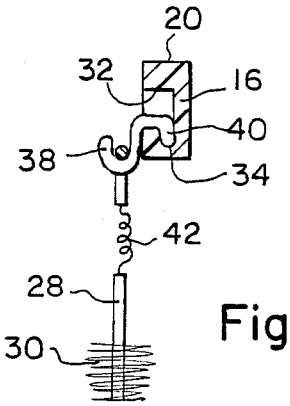
FIG. 7 is a cross sectional view taken along line 7—7 in FIG. 6.

FIGS. 6 and 7 show a modification in which the pair of hand grip ends 16 each having the plurality of detents 18 on the outer side 20 now have a track 32 with a plurality of transverse slots 34 in top surface 36. The elongated rods 26 are the same as in FIG. 1. A plurality of hook members 38 are provided. Each have one end 40 disposed within one of the slots 34 in the track 32. Each of the stainless steel individual wire loops 28 have a spring 42 therein. The wire loops 28 with the fibrous coarse plastic bristles 30 are held at each end by one of the hook members 38 securely in place and can be replaced when needed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A fork and comb cleaning tool comprising:

(a) a rectangular frame having hand grip ends adapted to be held in hand of user of said tool;

(b) a plurality of bristle wires spaced apart and extending longitudinally between said ends of said frame which will remove food particles from between prongs of a fork and remove scalp particles from between the teeth of a comb held in other hand of the user of said tool;

(c) each of said hand grip ends having a track thereon perpendicular to the wires with a plurality of spaced transverse slots intersecting said track;

(d) a pair of elongated rods forming part of said frame, spaced apart connecting said hand grip ends, each of said rods being thin enough to fit between the fork prongs and the comb teeth yet strong enough for structure support;

(e) a plurality of hooks each having a loop retaining end another end disposed within one of said slots; and (f) a series of individual replaceable extensible wire loops each having a spring th erein for extensibility each said wire loops removeably held at each end by one of said hook wherein said bristle wires are provided on said wire loops.

* * * * *